United States Patent [19]

Janezich et al.

[11] Patent Number: 4,930,568

[45] Date of Patent: Jun. 5, 1990

[54] HEAT EXCHANGER

[75] Inventors: Robert J. Janezich; Charles E. Cedar, both of Hibbing; Todd G. Dosen, Side Lake, all of Minn.

[73] Assignee: L and M Radiator, Inc., Hibbing, Minn.

[21] Appl. No.: 352,961

[22] Filed: May 17, 1989

[51] Int. Cl.[5] ..... F28F 9/02

[52] U.S. Cl. ..... 165/76; 165/159; 29/890.046; 29/890.047

[58] Field of Search ..... 165/76, 159, 173; 29/157.3 C, 157.3 R

[56] References Cited

U.S. PATENT DOCUMENTS

| | | | |
|---|---|---|---|
| 2,256,993 | 9/1941 | Van Vleet | 165/150 X |
| 2,816,739 | 12/1957 | Stoehr | 165/76 X |
| 3,391,732 | 7/1968 | Murray | 165/76 |
| 4,344,478 | 8/1982 | Petaja et al. | 165/69 |
| 4,360,057 | 11/1982 | Koump | 165/82 |

FOREIGN PATENT DOCUMENTS

| | | | |
|---|---|---|---|
| 29777 | of 1913 | United Kingdom | 165/76 |
| 406584 | 3/1934 | United Kingdom | 165/76 |
| 431863 | 7/1935 | United Kingdom | 165/76 |

*Primary Examiner*—Martin P. Schwadron
*Assistant Examiner*—Allen J. Flanigan
*Attorney, Agent, or Firm*—Allegretti & Witcoff, Ltd.

[57] ABSTRACT

A heat exchanger is described wherein each heat transfer tube is individually removable along its longitudinal axis such that a dense tube configuration within the heat transfer chamber can be maintained.

6 Claims, 1 Drawing Sheet

HEAT EXCHANGER

BACKGROUND OF THE INVENTION

The present invention relates generally to heat exchangers and more particularly to a heat exchanger having individually removable heat transfer tubes.

Heat exchangers of this type include a series of heat transfer tubes, held by header plates. A housing is fastened to the header plates so as to define a heat transfer chamber which substantially encompasses the heat transfer tubes. The housing includes inlet and outlet ports. The ends of each tube extend beyond the header plates into inlet and outlet chambers.

In operation, a first fluid is passed through the housing, via the inlet and outlet ports, over the heat transfer tubes. A second fluid is supplied to the inlet chamber, passes through the tubes and is withdrawn from the outlet chamber. Heat transfer may occur in either direction, i.e. from the first fluid to the second fluid or visa versa.

There are two important design considerations with respect to heat exchangers. First, it is desirable that the heat transfer tubes be individually removable so as to allow for ready repair. Second, one wishes to maximize the number of tubes and thereby maximize the heat transfer capacity of the unit.

In the past, these two design considerations competed against one another. Individual tube removability required open spaces within the heat transfer chamber and between tubes to allow for maneuvering. This, in turn, decreased tube density and unit capacity.

SUMMARY OF THE INVENTION

In a principal aspect, the present invention is an improved heat exchanger resulting from an unique combination of structure and assembly methodology. The present invention provides individual tube removability while maintaining high tube density. In addition, the repair process is simple and direct.

The improved heat exchanger includes a housing with first and second header plates secured therein so as to define a heat transfer chamber. The first and second header plates have openings adapted to receive and hold a series of heat transfer tubes. A simple cylindrical and lipped seal interposes each tube end and header plate.

The heat transfer tubes are substantially cylindrical and include a first end portion, a second end portion elongated with respect to the first end portion, and a central finned portion. A shoulder extends radially at the boundary between the central finned and second end portions. Significantly the maximum outer diameter of the heat transfer tube is less than the diameter of the openings in one of the header plates. The length of the first end and central finned portions of the heat transfer tube is also less than the distance between the first and second header plates in the assembled state. So configured, the heat transfer tube may be inserted through one such opening in the header plate and the first end portion thereof clears the first header plate and is free within the heat transfer chamber whenever the shoulder engages the second header plate.

During assembly or repair, a seal is positioned in the appropriate opening in the second header plate. The second end portion of the heat transfer tube is passed through the corresponding opening in the first header plate, inserted into this seal and advanced until the shoulder is adjacent the second header plate and in engagement with the seal. The first end portion is now disengaged from the first header plate and a seal is placed into the corresponding opening in the first header plate. The first end portion is then engaged with this seal and the heat transfer tube is adjusted to expose both end portions beyond the header plates.

It is thus an object of the present invention to provide an improved heat exchanger. A second object is to provide a heat exchanger with individually removable heat transfer tubes. Another object is a heat exchanger with removable tubes having a dense and compact tube configuration so as to provide substantial heat transfer capacity. It is also an object of the present invention to provide a high capacity heat exchanger which is readily repaired and cleaned in the field.

These and other features, objects and advantages of the present invention are described or implicit in the following detailed description.

BRIEF DESCRIPTION OF THE DRAWING

A preferred embodiment of the present invention is described with reference to the drawing wherein.

DETAILED DESCRIPTION OF A PREFERRED EMBODIMENT

Figure 1:
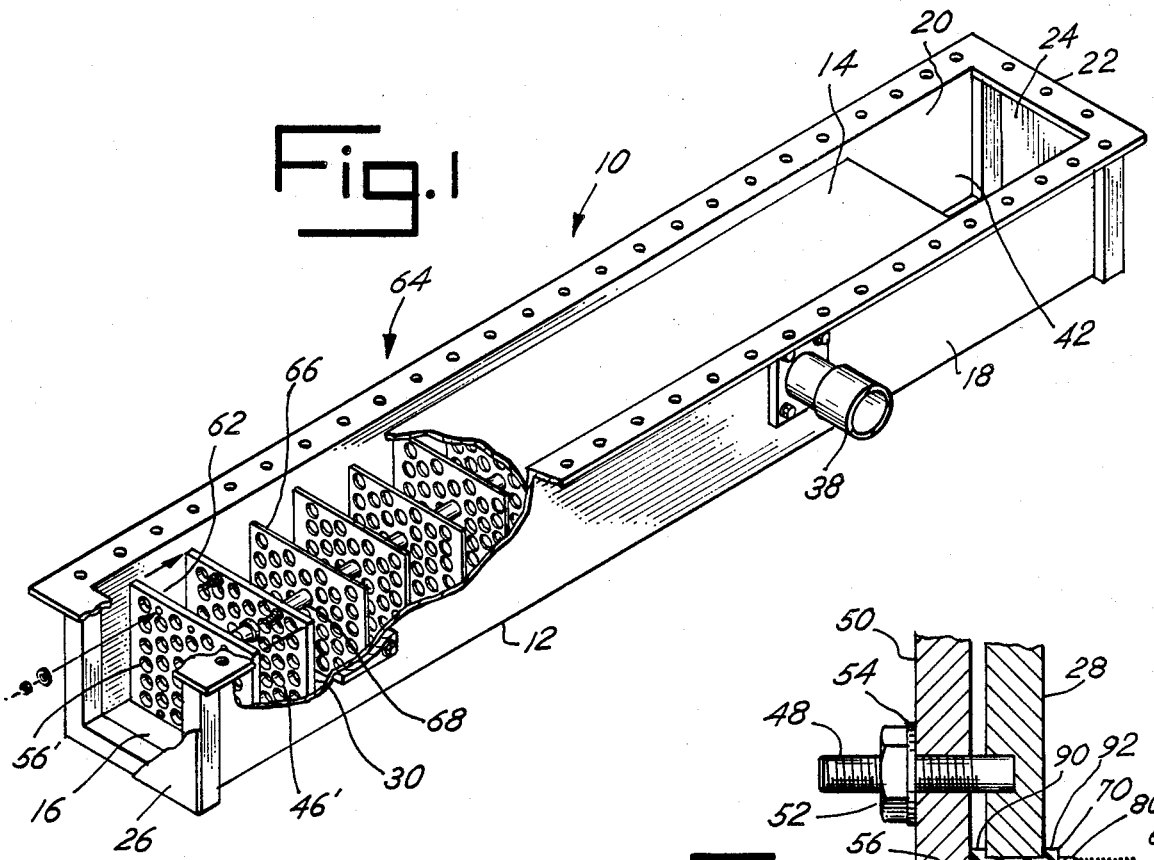
FIG. 1 is a partial cut-away, partial exploded perspective view of the heat exchanger.
Figure 3:
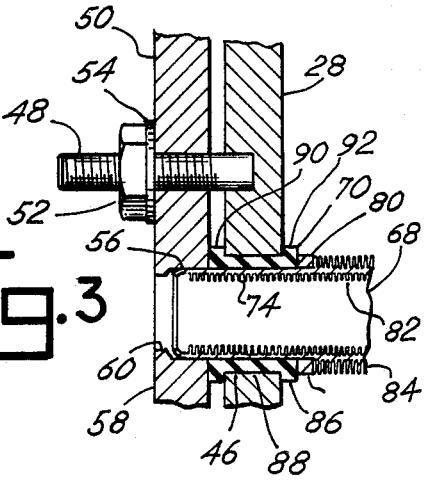
FIG. 3 is a partial cross-sectional view illustrating the configuration and cooperation of the header and retention plates.
Figure 2:
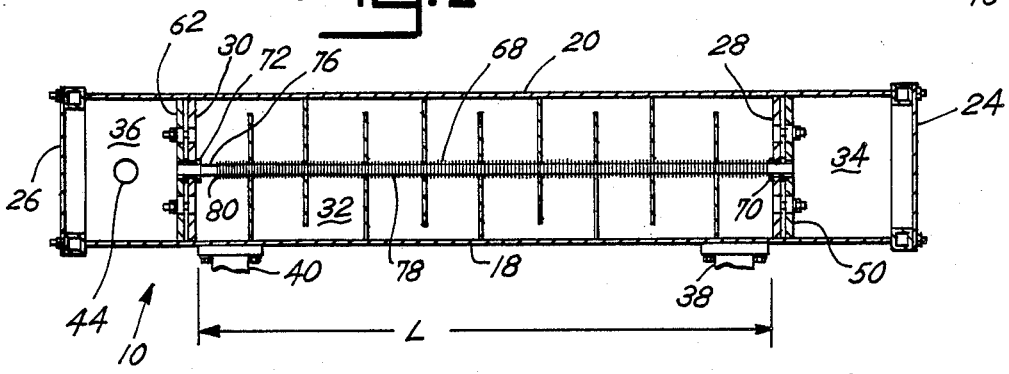
FIG. 2 is a top view of the heat exchanger with the top of housing removed.

A preferred embodiment of the present invention is shown in FIGS. 1-3 as an improved heat exchanger 10. The heat exchanger 10 is preferably a liquidto-liquid exchanger (e.g., a system utilizing water to cool oil).

The heat exchanger 10 includes a substantially rectangular housing 12 having a top 14, bottom 16, sidewalls 18, 20, and a mounting flange 22, preferably welded together. The housing 12 is closed by first and second end walls 24, 26, which are preferably bolted to the sidewalls 18, 20. Inlet and outlet header plates 28, 30 are secured, by bolting or welding, within the housing 12 so as to define a heat transfer chamber 32, an inlet chamber 34 and an outlet chamber 36. The inlet and outlet header plates 28, 30 thereby define the length of the heat transfer chamber 32, designated "L" in FIG. 2. A first liquid (not shown) circulates through the heat transfer chamber 32 from an inlet coupling 38 to an outlet coupling 40. A second liquid (not shown) is supplied to the inlet chamber 34 through an inlet port 42 and withdrawn from the outlet chamber 36 via an outlet port 44.

The inlet header plate 28 defines a series of inlet openings 46. In this preferred embodiment and as best shown in FIGS. 2 and 3, the inlet header plate 28 has inlet retention bolts 48 extending therefrom opposite the heat transfer chamber 32. In the assembled state, an inlet retention plate 50 is secured to the inlet header plate 28 by an inlet nut 52 and inlet lock washer 54. The inlet retention plate 50 defines a series of inlet retention openings 56 which match and correspond with the inlet openings 46. Referring particularly to FIG. 3, the diameter of inlet retention openings 56 at an external (in relation to the heat transfer chamber 32) edge portion 58 of the inlet retention plate 50 is slightly reduced to define an inlet lip 60.

The outlet header plate 30 has associated therewith an outlet retention plate 62. The outlet header and retention plates 30, 62 are identical in structural detail to the inlet header and retention plates 28, 50, respectively, and will be described with reference to FIGS. 1 and 3. The same reference numerals will be utilized, but a prime mark will be added therein for clarity.

The outlet header plate 30 includes outlet openings 46′ and outlet retention bolts 48′. The outlet retention plate 62, defining outlet retention openings 56′, is secured to the outlet header plate 30 by an outlet nut 52′ and outlet lock washer 54′. The outlet retention plate 62 also includes an outlet lip 60′ within each of the outlet retention openings 46′. In the assembled state, the four series of openings 46, 46′, 56, 56′ substantially align.

As is well known in the art, the heat exchanger 10 includes a series of baffles, generally designated 64, held by any of the conventional mechanisms within the heat transfer chamber 32. The baffles 64 are substantially rectangular plates, preferably equally spaced along the length "L" of the heat transfer chamber 32. Each baffle 64 defines a series of baffle openings 66, which also correspond and align one-for-one with the inlet openings 46 in the assembled state.

The baffles 64 are substantially identical having a height equal that of the housing 12 (i.e., the distance between the top 14 and bottom 16) and a width less than that of the housing 12 (i.e., the distance between sidewalls 18, 20). The baffles 64 engage the top 14 and bottom 16 of the housing 12 and alternately engage one of the sidewalls 18, 20 so as to produce a serpentine flow pattern through the heat transfer chamber 32 for the first liquid. The flow pattern is primarily perpendicular to the sidewalls 18, 20 to increase the efficiency of the heat exchanger 10.

The heat exchanger 10 also includes a series of heat transfer tubes 68, inlet seals 70 and outlet seals 72. Each heat transfer tube 68 is substantially cylindrical and has an overall length greater than that the heat transfer chamber 32 ("L"). The heat transfer tube 68 has a cylindrical first end portion 74 and a cylindrical second end portion 76, elongated with respect to the first end portion 74. Depending on dimensions, the second end portion 76 may be three or four times the length of the first end portion.

A substantially cylindrical, central finned portion 78 extends between the first and second end portions 74, 76, and an outlet, annular and radially extending shoulder 80 interposes the second end portion 76 and the central portion 78. In this preferred embodiment, the central portion 78 includes interior and exterior fins 82, 84 to increase heat transfer and efficiency. As best shown in FIGS. 2 and 3, the fins 82, 84 preferably have a raised, thread-like configuration such that the exterior fin 84 merges into the outlet shoulder 80 as well as an inlet shoulder 86 at the boundary with the first end portion 74. Referring particularly to FIG. 2, the heat transfer tubes 68 span the heat transfer chamber 32, and the first and second end portions 74, 76 extend substantially equally beyond the inlet and outlet header plates 28, 30, respectively, whenever the inlet shoulder 86 is adjacent the inlet header plate 28.

In this preferred embodiment, the maximum outer diameter of each heat transfer tube 68 is defined by the central finned portion 78 and is slightly less than the diameter of the inlet and outlet openings 46, 46′. The outer diameter of the first end portion 74 is substantially equal to that of the second end portion 76 and slightly less than that of the inlet and outlet retention openings 56, 56′ (except for the inlet and outlet lips 60, 60′).

The inlet and outlet seals 70, 72 are substantially identical in this preferred embodiment. The seals 70, 72 are substantially cylindrical and molded from a durable and flexible material, such as an elastomer. As best shown in FIG. 3, each seal 70, 72 includes central seal portion 88 of reduced outer diameter so as to define external and internal annular collars 90, 92, respectively. The inner diameter of each seal 70, 72 is only slightly less than the outer diameter of the first end portion 74 of each heat transfer tube 68 and the outer diameter of the central seal portion 88 is only slightly greater than the diameter of each inlet opening 46. The length of the central seal portion 88 (i.e., the distance between the external and internal collars 90, 92) is sufficient to span any inlet or outlet opening 46, 46′, and is preferably slightly less than the thickness of the inlet or outlet header plate 28, 30.

In the assembled state, the inlet and outlet seals 70, 72 are positioned within the inlet and outlet openings 46, 46′, respectively. Therein the seals 70, 72 are compressed and elongated, with the external and internal collars 90, 92 contacting the respective header plates 28, 30.

Each inlet seal 70 in the inlet header plate 28 slideably receives and sealingly engages the first end portion 74 of each heat transfer tube 68. Each outlet seal 72 similarly receives, engages and seals the second end portion 76 of each heat transfer tube 68.

In the assembled state, the inlet and outlet retention plates 50, 62 engage and support the inlet and outlet seals 70, 72, respectively. This substantially avoids dislodging of the inlet and outlet seals 70, 72 in high pressure applications. The inlet and outlet retention plates 50, 62 also receive the heat transfer tubes 68. The inlet and outlet lips 60, 60′ within the inlet and outlet retention openings 56, 56′, respectively, operate as stops to tube movement, thereby maintaining the position of the heat transfer tubes 68 with respect to the header plates 28, 30 and ensuring a sealed relationship between the inlet and outlet header plates 28, 30 and tubes 68.

The heat exchanger 10 is assembled and repaired in accordance with the following steps. An outlet seal 72 is positioned within an outlet opening 46′ in the outlet header plate 30. A heat transfer tube 68 is passed through the corresponding inlet opening 46 in the inlet header plate 28, through the baffle openings 66 until the second end portion 76 engages the outlet seal 72. The heat transfer tube 68 is advanced under force until the shoulder 80 thereof contacts the outlet seal 72.

At that point, the first end portion 74 is disengaged from the inlet header plate 28 and is entirely and freely within the heat transfer chamber 32. An inlet seal 70 is then positioned within the corresponding inlet opening 46 of the inlet header plate 28. The first end portion 74 is guided into sealing engagement with the inlet seal 70 and drawn through until the inlet shoulder 86 contacts and stops against the inlet seal 70. The first and second end portions 74, 76 of the heat transfer tube 68 now communicate with the inlet and outlet chambers 34, 36, respectively, for receipt of the second liquid. The inlet and outlet retention plates 50, 62 are then secured to avoid tube and seal displacement due to pressure, vibration and shock forces.

Significantly, each heat transfer tubes 68 is inserted into and withdrawn from the heat exchanger 10 along its longitudinal axis thereof. The space required for insertion or withdrawal is therefore minimized and only slightly greater than the cross-sectional area of the central finned portion 78, thereby allowing for necessary manipulation and maneuvering. This, in turn, permits a dense, tightly compacted tube arrangement within the heat transfer chamber 32 so as to maximize capacity for a given size heat exchanger 10.

Additionally, each heat transfer tube 68 and the associated seals 70, 72 can be replaced without opening the heat transfer chamber 32. Inexpensive seals 70, 72 may also be utilized.

A preferred embodiment of the present invention has been described herein. It is to be understood that modifications and changes can be made without departing from the true scope and spirit of the present invention, which are defined by the following claims to be interpreted in view of the foregoing. For example, the housing 12 may be cylindrical; the exterior fin 84 need not be thread-like; and the outer diameters of the first and second end portions 74, 76 of the heat transfer tubes need not be the same.

What is claimed is:

1. A heat exchanger comprising, in combination:

a housing including an inlet port and an outlet port;

a first header plate secured within said housing and defining a series of first openings therein, each of said first openings having a predetermined diameter;

a second header plate secured within said housing and defining a series of second openings therein;

said first and second header plates cooperating to define a heat transfer chamber, an inlet chamber and an outlet chamber within said housing, said inlet and outlet ports communicating within said heat transfer chamber;

a series of substantially cylindrical heat transfer tubes spanning said heat transfer chamber and communicating with said inlet and outlet chambers, said heat transfer tubes having a maximum outer diameter less than said predetermined diameter so as to permit passage of said heat transfer tube through said first openings of said first header plate, each of said heat transfer tubes including a first end portion, a central finned portion, a second end portion elongated with respect to said first end portion, and a shoulder interposed said central finned portion and said second end portion;

a series of first seals positioned within said first openings, each of said first seals slideably receiving said first end portion of each of said heat transfer tubes and providing a substantially leakproof seal between said first header plate and said first end portion; and a series of second seals positioned within said second openings, each of said second seals slideably receiving said second end portion of each of said heat transfer tubes and providing a substantially leakproof seal between said second header plate and said second end portion;

said first end portion of each of said heat transfer tubes disengaging said first header plate whenever said shoulder thereof is substantially adjacent said second header plate.

2. A heat exchanger as claimed in claim 1 further comprising:

a first retention plate secured to said first header plate and defining a series of first retention openings adapted to receive said first end portion of said heat transfer tubes, said first retention plate having a first lip within each of said first retention openings; and a second retention plate secured to said second header plate and defining a series of second retention openings adapted to receive said second end portions of said heat transfer tubes, said second retention plate having a second lip within each of said second retention openings;

said first and second lips positionally maintaining said heat transfer tubes with respect to said first and second header plates.

3. A heat exchanger as claimed in claim 2 wherein said first and second retention plates engage and support said first and second seals, respectively.

4. A heat exchanger as claimed in claim 1 wherein said central finned portion of each of said heat transfer tubes includes an external fin.

5. A heat exchanger as claimed in claim 3 wherein said external fin merges into said shoulder.

6. A method for manufacturing and maintaining a heat exchanger including inlet and outlet chambers, a heat transfer chamber having a predetermined chamber length, first and second header plates having first and second openings therein, respectively, first and second seals, and a series of heat transfer tubes having a first end portion and a central finned portion, comprising:

providing each of said heat transfer tubes with a second end portion, elongated with respect to said first end, and a shoulder interposed said central finned portion and second end portion such that said first end portion and said central finned portion define a tube length less than said predetermined chamber length;

positioning one of second seals in one of said second openings;

sliding one of said heat transfer tubes through a corresponding one of said first openings and engaging said second end portion thereof with said second seal;

forcing said second end portion through said second seal until said shoulder is substantially adjacent said second header plate, thereby disengaging said first end portion from said first header plate;

positioning one of said first seals in said corresponding one of said first openings;

engaging said first end portion of said heat transfer tube with said first seal; and forcing said first end portion through said first seal until said first and second end portions communicate with said inlet and outlet chambers.

* * * * *